US005532037A

United States Patent [19]

Aumann

[11] Patent Number: 5,532,037

[45] Date of Patent: Jul. 2, 1996

[54] WATERPROOF COLLAR CONNECTION DEVICE

[76] Inventor: Johann Aumann, Bergham 2, 83052 Bruckmühl, Germany

[21] Appl. No.: 318,589

[22] Filed: Oct. 5, 1994

[30] Foreign Application Priority Data

Oct. 5, 1993 [DE] Germany ..... 9315095 U

[51] Int. Cl.[6] ..... A41D 3/04

[52] U.S. Cl. ..... 428/99; 2/82; 2/87; 2/135; 2/904; 2/DIG. 5; 428/100; 428/101; 428/102; 428/122

[58] Field of Search ..... 428/122, 99, 100, 428/101, 102; 2/82, 135, 87, 904, DIG. 5

[56] References Cited

U.S. PATENT DOCUMENTS

| | | | |
|---|---|---|---|
| 3,090,047 | 5/1963 | Grazia | 2/135 |
| 3,449,764 | 6/1969 | Defazio | 2/82 |
| 3,953,566 | 4/1976 | Gore | 264/288 |
| 4,187,390 | 2/1980 | Gore | 428/304 |
| 4,194,041 | 3/1980 | Gore et al. | 428/315 |
| 4,493,870 | 1/1985 | Vrouenraets et al. | 428/245 |
| 4,507,806 | 4/1985 | Coombs | 2/85 |
| 4,604,759 | 8/1986 | Bowman | 2/87 |
| 4,725,481 | 2/1988 | Ostapchenko | 428/213 |
| 4,748,691 | 6/1988 | Grilliot et al. | 2/81 |
| 5,159,719 | 11/1992 | Aumann | 2/87 |
| 5,189,737 | 3/1993 | Ribicic | 2/87 |

FOREIGN PATENT DOCUMENTS

| | | |
|---|---|---|
| 7081491 | 10/1992 | Australia . |
| 0405062 | 1/1991 | European Pat. Off. . |
| 1355719 | 2/1964 | France . |
| 8910022 | 1/1990 | Germany . |

*Primary Examiner*—Nasser Ahmad

[57] ABSTRACT

A collar connection device is provided for use with a garment having a double-layer collar, the device having a first functional layer strip connected to sections of the garment by openable closures and a second functional layer strip also connected to sections of the garment by additional openable closures and where the two functional layer strips are attached in a line by a waterproof adhesive seam.

13 Claims, 1 Drawing Sheet

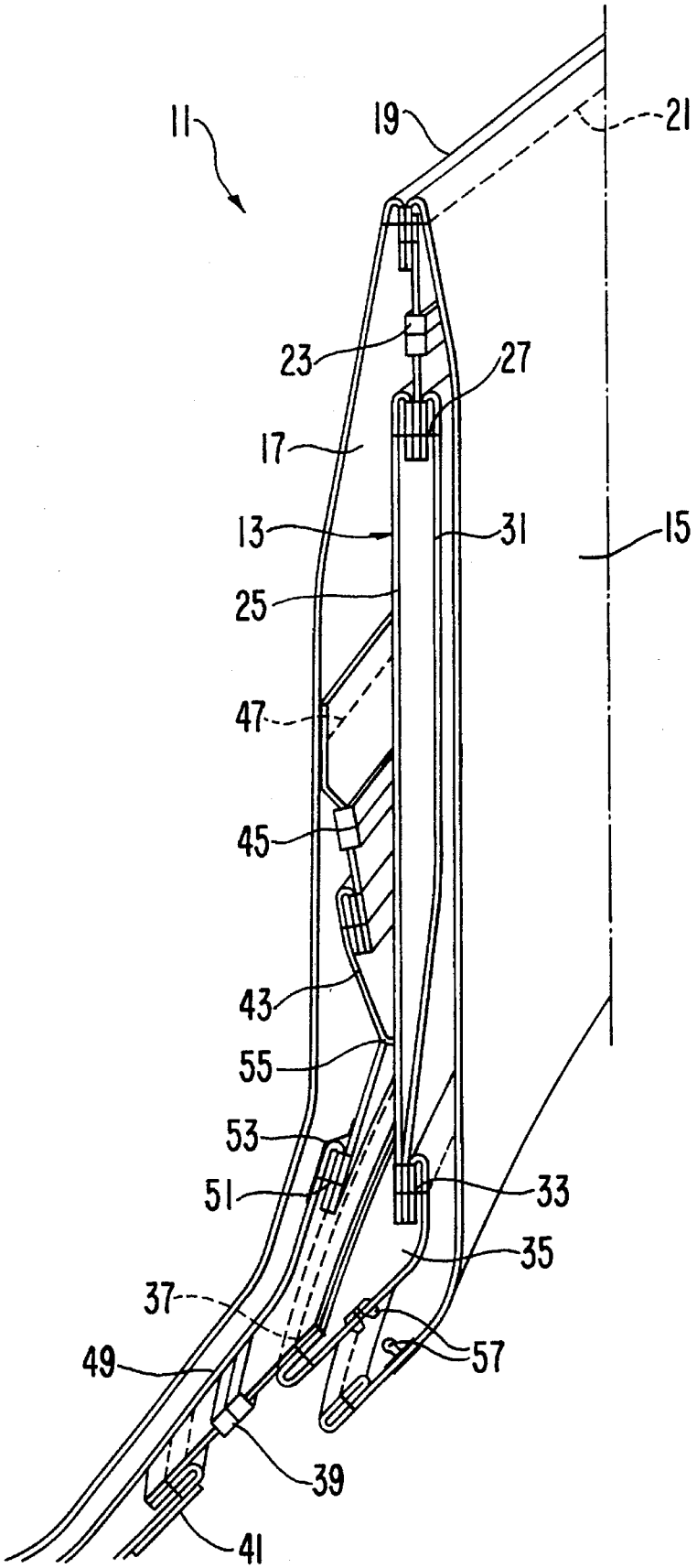
11
19
21
23
27
17
13
31
15
25
47
45
43
55
53
51
33
35
37
57
49
39
41

WATERPROOF COLLAR CONNECTION DEVICE

FIELD OF THE INVENTION

A collar connection device is provided for use with a garment having a double layer collar.

BACKGROUND OF THE INVENTION

Garments which are water vapor permeable and water permeable but which have been made waterproof by equipping them with a waterproof, water vapor permeable functional layer without compromising its water vapor permeability are very popular. Such garments have also proven valuable in workwear and protective work clothing. Some garments may become very dirty during their use, such as for example, fire fighters' jackets. These garments must undergo rigid cleaning procedures. Some of these rigid cleaning procedures have the potential of damaging the functional layer, particularly layers that are comprised of a microporous film of polytetrafluoroethylene (PTFE).

There is a need for a collar connection device for use in garments to allow easy disassembly and reassembly of inner liners. The device must maintain waterproofness when fully assembled.

SUMMARY OF THE INVENTION

A waterproof collar connection device is provided for use in a garment that has a detachable outer lining and/or a functional layer garment equipped with a waterproof functional layer which is arranged between the outer garment shell and the lining and wherein the garment has a double-layer collar. The collar connection device includes a first functional layer strip between the two collar layers with an upper edge that is connected to an upper collar edge by a first openable closure and with a lower edge which can be connected to the lining by a second openable closure and a second functional layer strip with an upper edge which can be connected to the inside of the outer collar layer by a third openable closure below the upper collar edge and with a lower edge which can be connected to the functional layer garment. The two functional layer strips are attached in a line located between the upper edge and the lower edge of the second functional line, approximately parallel to the upper edge of the first functional layer strip by means of a waterproof adhesive seam. The lower edge of the inner collar layer may be turned away from the outer collar layer by means of a fourth openable closure.

BRIEF DESCRIPTION OF THE DRAWINGS

The FIGURE is a schematic perspective section through a double-layer collar with a waterproof collar connection device.

DETAILED DESCRIPTION OF THE INVENTION

A waterproof collar connection device is provided which is comprised of a functional layer strip located between two material layers of a collar of a garment. The functional layer strip has an upper edge that is connected to an upper collar edge of a garment by a first openable closure. The functional layer strip also has a lower edge that is connected to a lining of a garment by a second openable closure. A second functional layer strip is also provided and has an upper edge that is connected to the inside of the outer material layer of the collar by a third openable closure located below the upper edge of the collar. The second functional layer strip also has a lower edge that is connected to a functional layer garment. The two functional layer strips are attached to each other in a line located between the upper edge and the lower edge of the second functional strip, about parallel to the upper edge of the first functional layer strip, by means of a waterproof adhesive strip. The lower edge of the inner collar layer is turned away from the outer material layer by means of a fourth openable closure.

The collar connection device may be used with a garment that originally did not have a functional layer garment to subsequently equip it with one after the original garment was constructed. Alternatively, the collar connection device may be used with a garment that has a detachable functional layer garment that may be removed from the outer garment shell prior to cleaning. A functional layer garment is herein defined as a lining having a functional layer that ensure the waterproofness and water vapor permeability of the garment.

The collar connection device may also be equipped with a connection facility for a detachable liner such as a thermal liner. The collar connection device is suitable for use with different types of garments including vests, jackets, and coats. Any of these garments may be worn with either the functional layer garment equipped with a waterproof and water vapor permeable layer or a simple lining such as a thermal lining, or a combination of the functional layer garment and lining.

Materials suitable for the functional layer comprise microporous expanded polytetrafluoroethylene (PTFE) as described in U.S. Pat. Nos. 3,953,566 and 4,187,390; expanded PTFE provided with hydrophilic impregnating agents and/or layers as described in U.S. Pat. No. 4,194,041; breathable polyurethane layers; or elastomers, such as copolyetheresters and their laminates, as described in U.S. Pat. Nos. 4,725,481 and 4,493,870.

The invention is best understood with reference to the attached FIGURE.

The FIGURE schematically shows a perspective section through a double-layer collar 11 with a waterproof collar connection device 13 located between an inner collar layer 15 and an outer collar layer 17. The two collar layers 15 and 17 are sewn to each other at an upper collar edge 19 by means of a sewn seam 21.

Furthermore, an upper zipper 23 is attached to the upper collar edge 19 by means of the sewn seam 21. A first functional layer strip 25 is sewn to the longitudinal side edge of the upper zipper 23 facing away from the upper collar edge 19 by a sewn seam 27. In the embodiment shown, the first functional layer strip 25 is underlaid with a stabilizing strip 31 consisting of any desirable material, such that the first functional strip 25 faces the outer collar layer 17 and the stabilizing strip 31 faces the inner collar layer 15. The functional layer strip 25 and the stabilizing strip 31 are attached to each other at a lower edge by a sewn seam 33. The sewn seam 33 also holds the upper edge of a clasp 35 to the lower edge of these two strips 25 and 31. A lower zipper 39 is attached to its lower edge by means of a sewn seam 37 and a detachable thermal lining 41 is sewn to its longitudinal strip edge facing away from the clasp 35.

A second functional layer strip 43 is located between the outer collar layer 17 and the first functional layer strip 25. Its upper edge is attached to the inside of the outer collar layer 17 by a sewn seam 47 via a center zipper 45. The sewn seam 47 is located below a collar turnback line extending in parallel to the edge 19 along which the upper part of the collar 11 is subsequently turned back over the outer collar layer 17. The lower edge of the second functional layer strip 43 is attached to the upper edge of a functional layer garment 49 by a sewn seam 51 which is sealed on the outside facing the outer collar layer 17 by means of a waterproof seam sealing tape 53. The second functional layer strip 43 and the first functional layer strip 25 are connected with each other by an adhesive seam 55 of a waterproof adhesive material, approximately in the middle between the upper edge and the lower edge of the second functional layer strip 43.

Complementary snap button elements 57 may be provided on the clasp 35 and at corresponding areas of the lower edge of the inner collar layer 15 to detachably attach the lower edge of the inner collar layer 15 to the clasp 35. This allows the inner collar layer 15 to be turned away from the outer collar layer 17 to allow access to all three zippers 23, 39 and 45 should the collar connection device 13 be separated from the collar 11 or connected to it in order to remove the functional layer garment and/or the lining from the outer garment shell or insert and attach these to the outer garment shell.

The stabilizing strip 31 serves to increase the stability of the collar connection device 11 but is not absolutely required.

The second functional layer strip 43 and its attachment below the turnback line are provided to keep the lining and the outer material of the garment in their correct positions relative to each other. For a collar which does not have a functional layer between the inner collar layer and the outer collar layer, the two collar material layers may be stitched through by a backstitch seam at a level corresponding approximately to that of the adhesive seam 55. If neither a stitched through seam nor an attachment by the center zipper 45 and the adhesive seam 55 is provided and if the collar is turned backwards (i.e., away from the head), the lining will hang out at the lower end of the garment. Further, the wearer would need to shake the lining into the correct position whenever the garment is put on.

The sewn seam 51 is sealed with a seam sealing tape 53 on the outside to prevent water which penetrates the outer collar layer 17 through the sewn seam 51 from reaching the inside of the functional layer garment 49. If water penetrates the functional layer garment 49, the water might either reach the thermal lining 41 or, if such a lining is not there, any garments worn underneath the garment.

The sewn seam 27 is not sealed by a seam sealing tape. If the user of the garment does not wear a helmet or hood, water may run into the collar of the garment on the inside of the inner collar layer 15. Since the sewn seam 27 is located relatively closely above the upper collar edge 19, it would be useless to seal the sewn seam 27 with a tape. Normally users, such as for example fire fighters, wear helmets and hoods which cover the sewn seam 27 so that water cannot reach the seam 27 over the outer-collar layer 17.

Water which runs through the outer collar layer 17 and reaches the area between the outer collar layer 17 and the functional layer strip 25 above the adhesive seam 55 is stopped by the adhesive seam 55.

The snap button elements 57 of the clasp 35 do not need to be waterproof or sealed because this area is protected against the ingress of water by the functional layer garment 49, by the seam sealing tape 53 and the adhesive seam 55.

In a garment which is not equipped with a thermal lining and which does not need the stabilizing strip 31, the lower edge of the inner collar layer 15 may be attached by a VELCRO closure directly on the functional layer garment 49. The counterpart of the VELCRO which is attached on the inner collar layer 15 would then be sewn to the functional layer garment and the seam would be sealed with a seam sealing tape.

I claim:

1. A waterproof collar connection device for use with a garment which has a detachable lining and a functional layer garment equipped with a waterproof, water vapor permeable functional layer, the garment having a double-layer collar with an outer collar layer and an inner collar layer and where the device is arranged between the garment and lining, said device comprising:

(a) a first functional layer strip located between the two collar layers, said strip having an upper edge connected to an upper collar edge by a first openable closure and a lower edge connected to the lining by a second openable closure; and (b) a second functional layer strip having an upper edge connected to the inside of the outer collar layer by a third openable closure and a lower edge connected to the functional layer garment, wherein the two functional layer strips are attached in a line located between an upper edge and a lower edge of the second functional layer strip, about parallel to the upper edge of the first functional layer strip by a waterproof adhesive seam and wherein the lower edge of the inner collar layer may be turned away from the outer collar layer by a fourth openable closure.

2. A collar connection device of claim 1 further comprising a clasp having an upper edge attached to the lower edge of the first functional layer strip and a lower edge connected to the second openable closure.

3. A collar connection device of claim 2, wherein one side of the fourth openable closure is arranged on the clasp.

4. A collar connection device of claim 1 wherein the first functional layer strip is further provided with a stabilizing strip located under the first functional layer strip.

5. A garment constructed of a water permeable material having a detachable lining, a double-layer collar including an inner collar layer and an outer collar layer, and a collar connection device which attaches the detachable lining to the garment, wherein said collar connection device comprises:

(a) a first functional layer strip located between the two collar layers, said strip having an upper edge connected to an upper collar edge by a first openable closure and a lower edge connected to the detachable lining by a second openable closure; and (b) a second functional layer strip having an upper edge connected to the inside of the outer collar layer by a third openable closure, wherein the two functional layer strips are attached in a line located between an upper edge and a lower edge of the second functional layer strip about parallel to the upper edge of the first functional layer strip by a waterproof adhesive seam and wherein the lower edge of the inner collar may be turned away from the outer collar layer by a fourth openable closure.

6. A garment of claim 5 having an inner collar turned back along a turnback line wherein the third openable closure device is attached to the outer collar layer in the area of the turnback line.

7. A garment of claim 5 wherein at least one of the openable closures is a zipper.

8. A garment of claim 5 wherein the fourth openable closure includes complementary snap button elements arranged on the lower edge of the inner collar layer and on the functional layer clasp.

9. A garment of claim 5 wherein the lower edge of the second functional layer strip is connected to an upper edge of an optional functional layer garment by a sewn seam and wherein the sewn seam is sealed on the outside facing the outer collar layer with a seam sealing tape so as to make waterproof.

10. A garment constructed of a water permeable material having a functional layer garment with a functional layer located inside the garment, a double-layer collar including an inner collar layer and an outer collar layer, and a collar connection device which detaches the detachable lining to the garment, wherein said collar connection device comprises:

(a) a first functional layer strip located between the two collar layers, said strip having an upper edge connected to an upper collar edge by a first openable closure; and (b) a second functional layer strip having an upper edge connected to the inside of the outer collar layer by a second openable closure and a lower edge connected to the functional layer garment, wherein the two functional layer strips are attached in a line attached between an upper edge and a lower edge of the second functional layer strip about parallel to the upper edge of the first functional layer strip by a waterproof adhesive seam and wherein the lower edge of the inner collar layer is connected to the inner side of the functional layer garment by a third openable closure.

11. A garment of claim 10 wherein the third openable closure is formed by a velcro closure having a first VELCRO part attached to the functional liner by a seam which is subsequently sealed with a waterproof seam sealing tape.

12. A garment constructed of a water permeable material outer shell having a detachable lining and a functional layer garment equipped with a waterproof, water vapor permeable functional layer, the garment having a double-layer collar with an outer collar layer and an inner collar layer and a collar connection device which attaches the detachable lining to the garment and is arranged between the garment and the lining, wherein said collar connection device comprises:

(a) a first functional layer strip located between the two collar layers, said strip having an upper edge connected to an upper collar edge by a first openable closure and a lower edge connected to the lining by a second openable closure; and (b) a second functional layer strip having an upper edge connected to the inside of the outer collar layer by a third openable closure and a lower edge connected to the functional layer garment, wherein the two functional layer strips are attached in a line located between an upper edge and a lower edge of the second functional layer strip, about parallel to the upper edge of the first functional layer strip by a waterproof adhesive seam and wherein the lower edge of the inner collar layer may be turned away from the outer collar layer by a fourth openable closure.

13. A garment of claim 12 wherein at least one of the openable closures is a zipper.

* * * * *